United States Patent [19]

Hull

[11] Patent Number: 5,049,102

[45] Date of Patent: Sep. 17, 1991

[54] RECREATIONAL RAFT APPARATUS

[76] Inventor: Michael Hull, 4142 Crossing La., Dallas, Tex. 75220

[21] Appl. No.: 289,230

[22] Filed: Dec. 22, 1988

[51] Int. Cl.[5] ..... B63C 9/00

[52] U.S. Cl. ..... 441/41; 441/42; 441/125; 441/129

[58] Field of Search ..... 441/35, 38, 40, 41, 441/42, 125, 126, 129, 130

[56] References Cited

U.S. PATENT DOCUMENTS

| | | | |
|---|---|---|---|
| 1,864,648 | 6/1932 | Haines | 441/125 |
| 2,369,736 | 2/1945 | Hurt | 441/129 |
| 2,609,549 | 9/1952 | Krupp | 441/42 |
| 3,769,647 | 11/1973 | Basa | 441/38 |
| 4,693,691 | 9/1987 | De Yoe | 441/129 |

FOREIGN PATENT DOCUMENTS

| | | | |
|---|---|---|---|
| 2411229 | 9/1975 | Fed. Rep. of Germany | 441/40 |

*Primary Examiner*—Sherman D. Basinger
*Assistant Examiner*—Stephen P. Avila
*Attorney, Agent, or Firm*—Hubbard, Thurman, Tucker & Harris

[57] ABSTRACT

A recreational raft apparatus which comprises an inflatable, floatable body portion, and at least one closable pocket in association with the body portion of the raft. The raft may further comprise an inflatable pillow which is attached to the body portion, as well as handles attached to the body portion of the raft for carrying the raft. A towel may be attached to the top side of the raft by clips.

4 Claims, 3 Drawing Sheets

RECREATIONAL RAFT APPARATUS

BACKGROUND OF THE INVENTION

This invention comprises a recreational raft apparatus which can be used to contain various articles needed for the beach and the water. More particularly, this invention comprises a floatable raft which may be designed so as to be easily folded and carried in its flattened position as a beach tote bag and then opened up for use as a raft.

Many different types of inflatable rafts are known. Typically, a plastic raft is inflated with air and used to float on the water. The beach goer or pool frequenter must carry with him a deflated raft to be inflated at some later point, as well as other items such as beach shoes, towels, suntan lotion, sunglasses, hat, beach toys and the like. This results in the necessity of a separate bag or tote to carry the additional items.

Sometimes it is desired that the separate bag or tote and the various items within not be left on the beach or by the side of the pool while one is swimming and floating on the raft. Oftentimes when one is lying on the raft in the water, one does not wish to take the time to go back to the beach or the side of the pool to reach items needed such as a hat, sunglasses, suntan lotion and the like. However, an attempt at carrying these items on the typical raft often results in the items falling off the raft unless they are continuously held by the person lying on the raft.

A recreational raft is needed which provides a way of carrying items as a tote bag to the beach or pool as well as a way of containment of those items.

SUMMARY OF THE INVENTION

In a preferred embodiment thereof, the present invention provides an inflatable floatable raft having an inflatable body portion, a means for containment and receipt of articles, the means being in association with a body portion of raft, and a closure means disposed in association with the means for containment. The raft may further comprise an inflatable pillow which is attached to the body portion, as well as a handle attached to the body portion of the raft for conveniently permitting the raft to be hand-carried in its flattened, carryable position. A plurality of clips may be used for attaching a towel to the top side of the raft.

DETAILED DESCRIPTION

Figure 1:
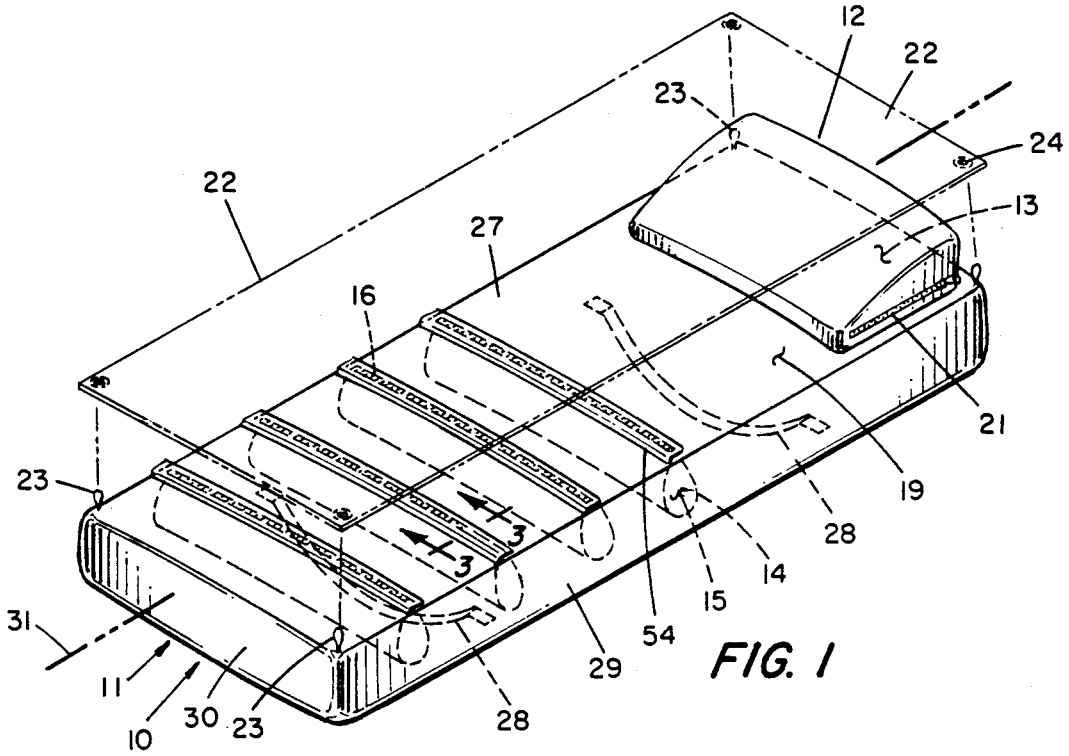
FIG. 1 perspectively illustrates an inflated raft of the present invention including pouches disposed within the body of the raft.
Figure 2A:
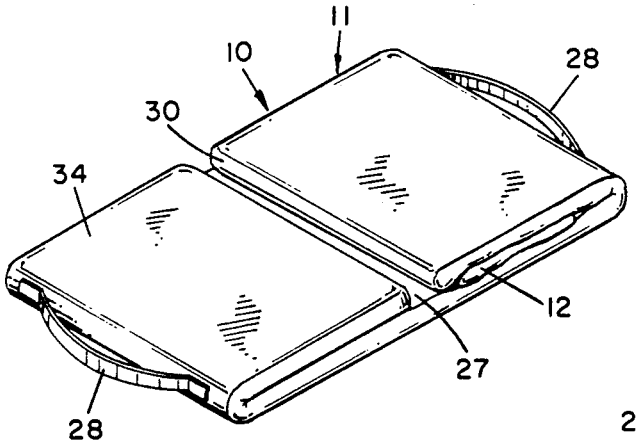
FIGS. 2A and 2B perspectively illustrate the raft in its deflated state folded into two raft halves and in a carryable position.
Figure 2B:
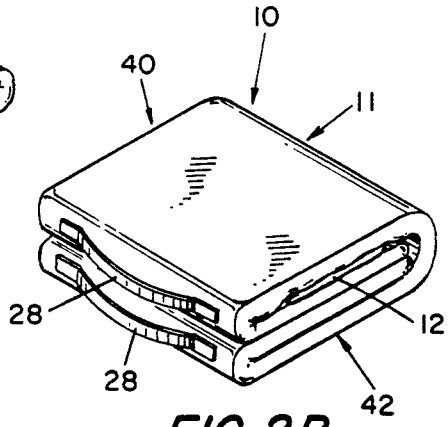
Figure 3:
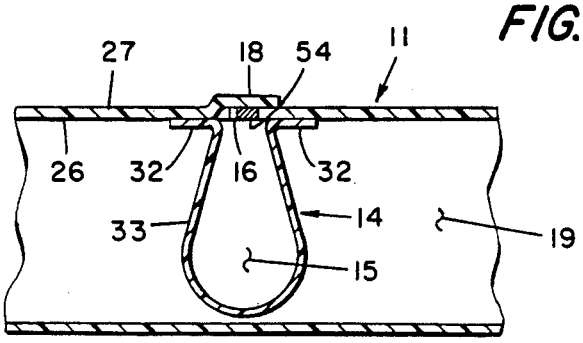
FIG. 3 is a fragmentary cross-sectional view through the body portion and a pouch of the raft taken along line 3—3 of FIG. 1.

FIGS. 1-3 show one embodiment of a raft according to this invention. FIGS. 4-8 show yet another embodiment.

Referring to FIG. 1, raft 10 comprises body portion 11 and pillow 12 attached thereto. Pillow cavity 13 is provided for containment of various articles, for example a bellows pump (not illustrated) with which to inflate raft 10. At least one means for containment of articles, preferably a pouch 14, is positioned within the body portion cavity 19 of body portion 11 of raft 10. Pouch 14 extends tranversely to axis 31 of raft 10 within body portion cavity 19. Preferably, a plurality of pouches 14 are placed within body portion cavity 19. As shown in FIG. 3, pouches 14 are preferably attached to the inside surface 26 of the top side 27 of body portion 11. Pouch 14 has one or more upper edge portions 32 and pouch 14 is attached to inner surface 26 of top 27 of body portion 11 at upper edge portion 32 of pouch 14. Pouch 14 is positioned within body portion cavity 19 in such a way as to depend from the top side 27. Alternatively, pouch 14 can be attached to inner surface 26 of top 27 of body portion 11 by attachment of side 33 of pouch 14 to inner surface 26 of body portion 11.

The type of material used for pouch 14 can vary and the thickness of the material used may determine, to some degree, the shape and position of pouch 14 within body portion cavity 19. Pouches 14 are arranged in a transverse direction to axis 31. Alternatively, pouches 14 may project inwardly from and be attached to either opposite sides 29 of body portion 11 or opposite ends 30 of body portion 11. Likewise, pouches 14 can extend within body portion cavity 19 in an axial direction. Pouch cavity 15 is provided within pouch 14 for containment of articles therein.

A closure means is associated with pouches 14 so that pouch cavity 15 can be accessed by a person lying on top 27 of raft 10 through access opening 54 which extends outwardly through body portion 11. Preferably, the closure means is a body portion zipper 16 which is essentially watertight. Body portion zipper 16 is positioned on top 27 of body portion 11 and extends tranversely to the longitudinal axis 31 of raft 10. Body portion zippers 16 as well as pillow zipper 21 are each covered by flap 18 which extends over body portion zipper 16 and pillow zipper 21. Body portion zipper 16 and pillow zipper 21 may be integrated into body portion 11 and pillow 12, respectively, by some suitable means of attachment such as stitching, or the like. Preferably, body portion zipper 16 and pillow zipper 21 are made of a plastic or plastic coated material to inhibit rusting and are essentially watertight.

Flap 18 covers body portion zipper 16 and pillow zipper 21 as an extension of body portion 11 of top 27. Alternatively, flap 18 may be sewn on or attached to body portion 11 as a separate component. Flap 18 need not cover all of body portion zipper 16 and pillow zipper 21. Flap 18 decreases contact by water with body portion zipper 16 and body portion cavity 19 and adds to the comfort of the person lying on raft 10.

A plurality of clips 20 are provided for attaching a towel 22 to raft 10. Clips 20 are attached to the corners 23 of body portion 11 of raft 10. Eyelets 24 for receiving clips 20 are positioned at the corners of towel 22 and include rings affixed thereto to protect towel 22 from clips 20. Clips 20 may be clothespin-type clips or other conventional clip devices. Handles 28 are preferably included and are attached to bottom 34 of body portion 11, about one-fourth of the distance from opposite ends 30 of body portion 11. Handles 28 may be used to carry raft 10 in a flattened carryable position.

FIGS. 2A and 2B, illustrate the folding of raft 10 to its carryable position. Referring to FIG. 2A, opposite ends 30 are folded toward each other onto top 27 of body portion 11 at a point about one-fourth of the distance along body portion 11 to opposite ends 30 of body portion 11. Raft 10 is folded at about the location of handles 28.

Referring to FIG. 2B, raft 10 is folded into a carryable position by folding raft 10 at a point between opposite ends 30 of body portion 11 so that bottom 34 of body portion 11 is on the inside. Two folded raft halves 40 and 42 are thereby formed in immediate folded contact with each other and having handles 28 in close proximity to each other. Raft 10 is then grasped and carried by handles 28.

Referring to FIG. 3, a cutaway view along lines 3—3 in FIG. 1 is shown in which pouch 14 with cavity 15 therein extends and depends from top 27 of body portion 11. Upper edge portions 32 of pouch 14 are attached to inner surface 26 of body portion 11. Body portion zipper 16 is integral within body portion 11 and provides an opening at the top of pouch cavity 15. Flap 18 extends over and covers body portion zipper 16. Alternatively, side 33 of pouch 14 could be attached in a manner to inner-surface 26 of body portion 11 which does not utilize upper edge portions 32 of pouch 14.

Various materials may be used to make raft 10 and the various components of raft 10, such as body portion 11, pillow 12 and pouches 14. Any materials which are inflatable, foldable and at least water resistant are suitable, and different materials may be used for different components. For example, one pouch 14 may be lined on the inside with plastic. Pillow 12 may be made of a different material than the body portion 11 of raft 10. Preferably, a plastic material is used to make raft 10, although raft 10 could also be made of a styrofoam type material and covered with a utility cover. The utility cover may be made of any durable material such as windbreaker type fabric.

Additional closures and holders may be added to raft 10, if desired, such as indentations in body portion 11 to hold drinks or pull out pockets and pouches. Various decorative touches may be provided, such as buttons or creases where top 27 and bottom 34 of body portion 11 are adhered together.

Raft 10 may be manufactured by conventional manufacturing methods, such as stitching or heat-laminating two multilaminate sheets together or by molding styrofoam. Pillow 12 may be manufactured as a part of body portion 11 or may be detachable by some suitable means, such as velcro.

A means for carrying raft 10, such as handles 28 are preferably included. Connecting devices (not shown) may be added to the bottom portions 34 near handles 28 to connect to each other so as to hold the folded raft halves 40 and 42 together as shown in FIG. 2B. Velcro or other conventional connecting devices may be used for said connecting devices.

FIGS. 4–8 show yet another embodiment of a raft of the present invention.

Figure 4:
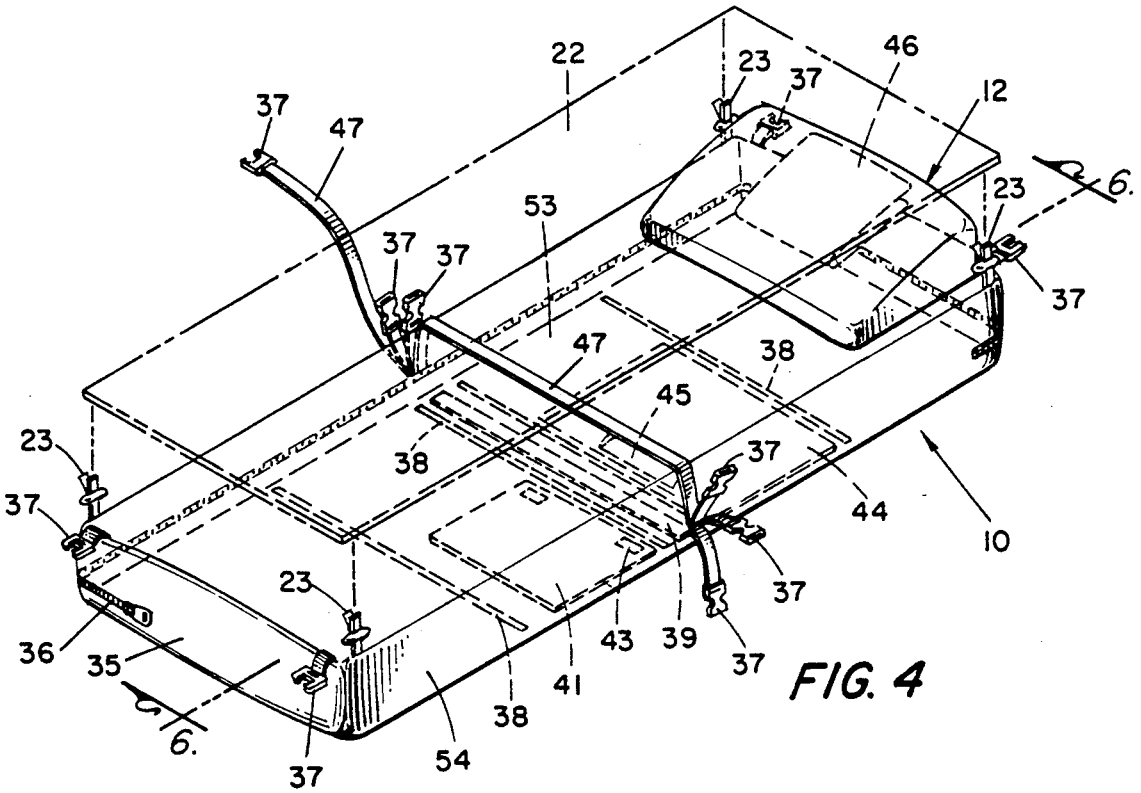
FIG. 4 shows an alternate embodiment of the raft with a utility cover on the body portion of the raft with placement of pockets on the utility cover and the outline of a pillow attached to the body portion.

FIG. 4 shows a raft 10 with a utility cover 35 on the body portion 11 of raft 10. Body portion 11 has been deleted for clarity, however, the outline of body portion 11 and pillow 12 which is attached to body portion 11 may be seen in FIG. 4. Utility cover 35 has a cover zipper 36 which facilitates the enclosure by utility cover 35 of body portion 11 and easy removal of body portion 11 from utility cover 35. At least one fastener 37 is attached in some manner to utility cover 35 and is provided so as to cooperate with at least one fastener 37 placed at a midpoint of the side of utility cover 35 so that the raft can be folded and fastened as shown in FIG. 5.

Referring to FIG. 4, at least one pocket 53 is provided within said utility cover 35 and a pocket zipper 38 is provided in association with each pocket 53. Bar 39 is attached to utility cover 35 at a mid-section of utility cover 35. This bar may be disposed within two layers of material of utility cover 35. Various pouches may be disposed within pockets 53 such as a detachable wet pouch 41 with velcro 43 which is provided to removably attach wet pouch 41 to pocket 53. Cooling pouch 43 may be disposed within pocket 53 and contains an aperture 45 to allow a hand grip of cooling pouch 44. Bellows pocket 46 may be located within utility cover 35, as well. Strap 47 is attached to utility cover 35 for carrying raft 10 in a folded position.

Figure 5:
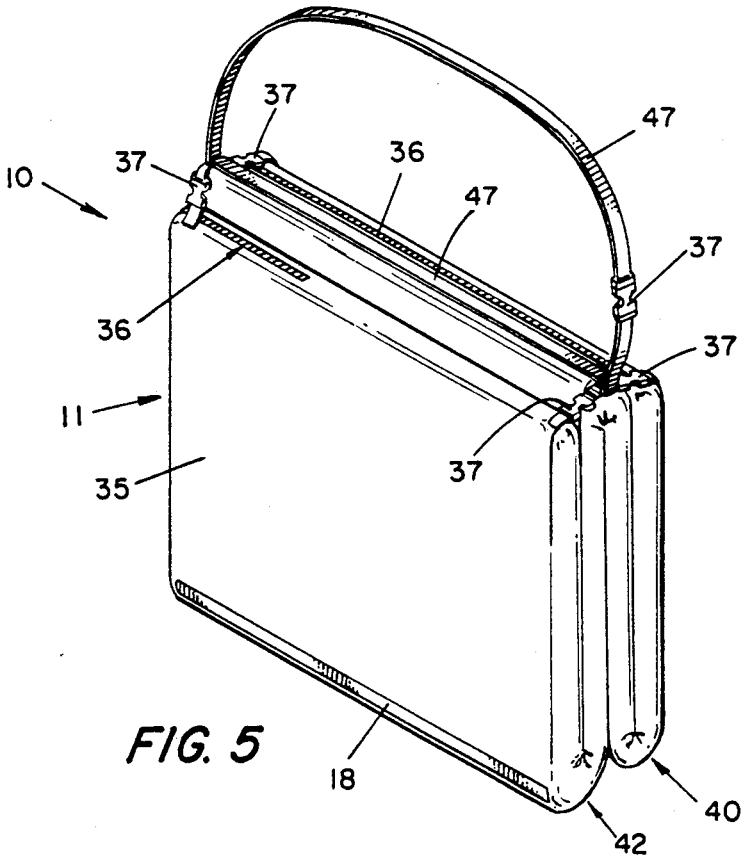
FIG. 5 perspectively illustrates the raft disposed within a utility cover, with the raft's body portion in its deflated state, and a strap, in a folded, carryable position.

Referring to FIG. 5, raft 10 contains utility cover 35, body portion 11 in its deflated state, and strap 47 in a folded, carryable position. Raft 10 is folded into a carryable position by folding raft 10 at a point between opposite ends 30 of body portion 11. Two-folded raft halves 40 and 42 are thereby formed in immediate folded contact with each other, having fasteners 37 which are used to removably fasten raft halves 40 and 42. Strap 47 is then used to carry raft 10.

Figure 7:
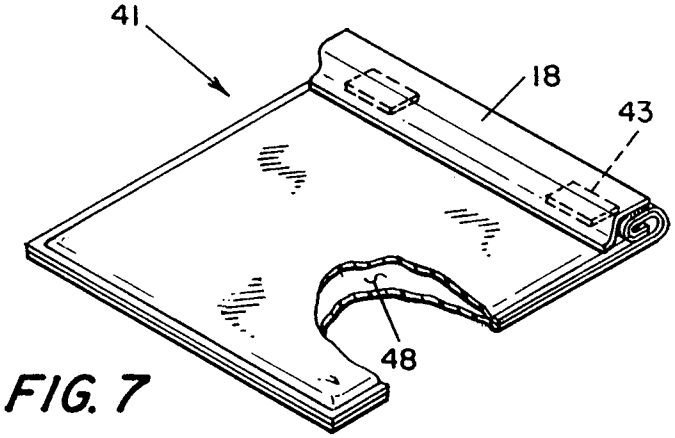
FIG. 7 is a partially cutaway perspective view of a wet pouch which may be contained within a pocket of a utility cover or a pouch of a body portion of either raft.

FIG. 7 shows a partially cutaway view of a wet pouch 41 which may be located inside pocket 53 of utility cover 35. Various wet items such as bathing suits and the like may be contained within pouch cavity 48 of wet pouch 41. Some suitable means for fastening closed wet pouch 41 such as velcro 43 may be used with flap 18 extending over velcro 43. Wet pouch 41 may be made of a waterproof or water resistant material or may be lined with such material.

Figure 8:
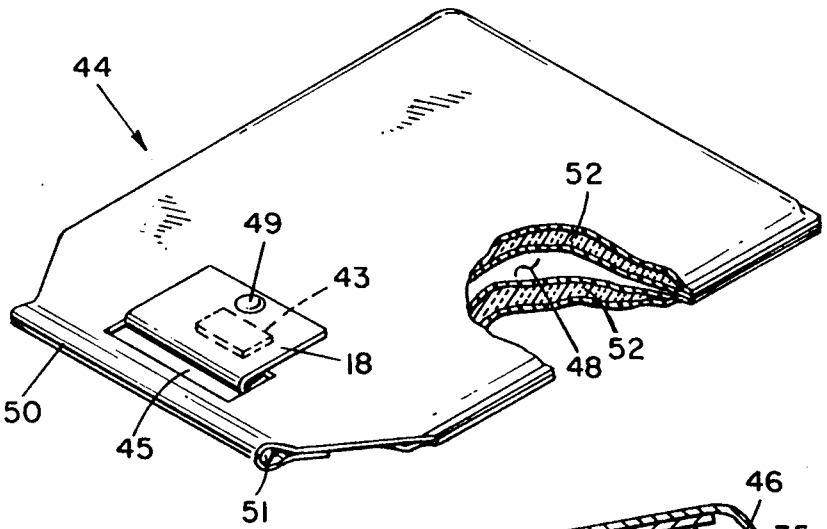
FIG. 8 is a partially cutaway perspective view of an insulated cooling pouch which may be contained within a pocket of a utility cover or a pouch of a body portion of either raft.

Referring to FIG. 8, cooling pouch 44 may be located within pocket 53 in order to keep food and/or drinks cool. Cooling pouch 44 is provided with insulation 52 between the layers of cooling pouch 44. The items to be kept cold may be placed within pouch cavity 48. A means for carrying cooling pouch 44 is provided by a handle 50 with a dowel made of wood or fiberglass or some suitable material inserted therein. A aperture 45 is located near handle 50 so that flap 18 from the bottom side of cooling pouch 44 may be inserted through aperture 45 and then removably attached to the top side of cooling pouch 44 by means of velcro 43 or a snap 49.

Figure 6:
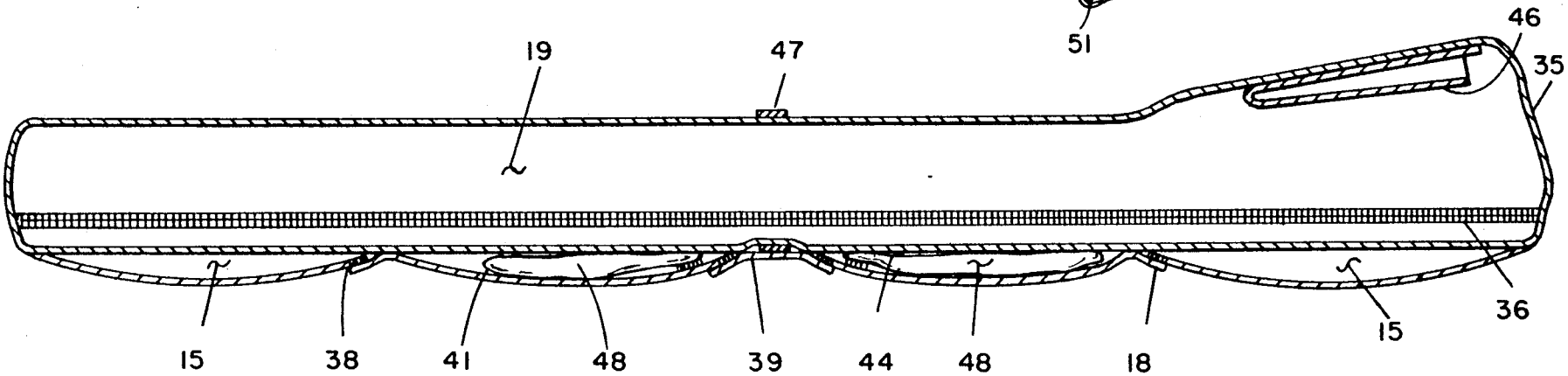
FIG. 6 is an enlarged scale cross-sectional view through the utility cover taken along line 6—6 of FIG. 4. The raft in FIG. 6 has been deleted for clarity.

Referring to FIG. 6, utility cover 35 is shown with raft 10 enclosed therein. Raft 10 in FIG. 6 has been deleted for clarity. A bellows pocket 46 is shown attached to the underside of the top of utility cover 35 for receipt of a bellow pump or other suitable inflation device. Cover zipper 36 is shown in FIG. 6 as are pocket cavities 15 which contain cooling pouch 44 and wet pouch 41. Bar 39 and strap 47 are also illustrated.

Other modifications, variations and embodiments of this invention will be apparent to one of ordinary skill in the art.

What is claimed is:

1. A recreational raft apparatus which comprises:

an inflatable, floatable body portion, to which is attached an inflatable pillow, wherein said body portion and said pillow each contain at least one essentially watertight zipper, wherein a plurality of body portion zippers are positioned on the top of said body portion and extend transversely to the axis of said raft, wherein each of said plurality of body portion zippers is associated with a pouch to contain articles, wherein said pouches extend transversely to the axis of said raft within said body portion cavity and are attached to the inner-surface of the top of said body portion;

a plurality of flaps attached to said body portion, each of which extend over and essentially cover one of said body portion zippers and said pillow zippers;

two handles attached to said body portion of said raft at a point about one-fourth of the distance to the end of said body portion; and a plurality of means for attaching a towel to the top side of said raft.

2. A recreational raft apparatus comprising:

an inflatable, floatable body portion with an inflatable pillow attached to said body portion;

a utility cover which contains said body portion, said utility cover including a plurality of pockets, each of said pockets having an access opening extending outwardly through said body portion;

a zipper associated with each pocket of said utility cover to selectively open and close said access opening;

a strap attached to said utility cover;

a plurality of means for attaching a towel to the top of said utility cover; and a means for inflating said raft, wherein said means for inflating said raft is contained within a pocket in said utility cover and accessible by a zipper associated with said pocket.

3. The raft if claim 2, wherein one or more of said pockets have a detachable pouch for containment of articles disposed therein.

4. The raft of claim 3, wherein insulation material is disposed between the walls of said detachable pouch.

* * * * *